US005816316A

United States Patent [19]

Hoffnung

[11] Patent Number: 5,816,316

[45] Date of Patent: Oct. 6, 1998

[54] HEAT EXCHANGER WITH A BRAZED HEADER, IN PARTICULAR FOR A MOTOR VEHICLE

[75] Inventor: Jacques Hoffnung, L'Ile Saint Denis, France

[73] Assignee: Valeo Thermique Moteur, Le Mesnil-Saint Denis, France

[21] Appl. No.: 808,979

[22] Filed: Feb. 19, 1997

[30] Foreign Application Priority Data

Feb. 20, 1996 [FR] France ..... 96 02066

[51] Int. Cl.[6] ..... F28F 9/02

[52] U.S. Cl. ..... 165/76; 165/173; 228/183

[58] Field of Search ..... 165/76, 79, 173; 29/890.052, 890.054; 228/183

[56] References Cited

U.S. PATENT DOCUMENTS 2,073,778 3/1937 Boerger .
3,857,164 12/1974 Chartet .
4,582,127 4/1986 Moranne .

FOREIGN PATENT DOCUMENTS 2 349 813 11/1977 France .

OTHER PUBLICATIONS

French Search Report dated Nov. 4, 1996.

*Primary Examiner*—Allen J. Flanigan
*Attorney, Agent, or Firm*—Morgan & Finnegan

[57] ABSTRACT

A tubular heat exchanger for a motor vehicle has a header comprising a header plate and a header cover brazed to the header plate. The header plate has a base portion which is arranged to be joined to the bundle of tubes of the heat exchanger, and the header cover is terminated by a peripheral edge portion which is engaged within a peripheral flange of the header cover surrounding the base portion of the latter. This base portion is provided with a multiplicity of press-formed projecting elements which are spaced apart close to the peripheral flange, and the peripheral edge portion of the header cover is held in contact with the header plate flange by these projecting elements prior to the brazing operation by which the edge portion of the cover is brazed to the header plate flange.

9 Claims, 2 Drawing Sheets

HEAT EXCHANGER WITH A BRAZED HEADER, IN PARTICULAR FOR A MOTOR VEHICLE

FIELD OF THE INVENTION

This invention relates to heat exchangers with brazed headers, in particular for motor vehicles. More particularly, it concerns a heat exchanger comprising a header plate having a base portion which is adapted to be joined to a bundle of tubes, with a header cover terminated by a peripheral edge portion which is adapted to be engaged within a peripheral flange of the header plate, with a view to the header plate and header cover being subsequently fixed together by a brazing operation.

BACKGROUND OF THE INVENTION

Numerous heat exchangers of the above type are known, in which the components of the heat exchanger are commonly made of aluminium or an aluminium alloy, and are assembled together by a brazing operation in which the assembled components are appropriately heated in an oven.

One of the problems that arises in the fabrication of such heat exchangers is that of ensuring tight contact between the edge of the header cover and the flange of the header plate, such that the brazing operation produces a sealed joint without any risk of leakage arising. Since brazing is generally obtained by means of a thin coating disposed on the header plate and/or on the header cover, it is necessary that the edge portion of the header cover and the flange of the header plate shall be in proper surface contact over the whole perimeter of the header.

In one known arrangement, the header plate is provided with a press-formed groove in which the edge portion of the header cover is engaged. This arrangement facilitates the provision of a reduced clearance which is such as to guarantee a sealed brazed joint between the header cover and the header plate, regardless of any deformation that may be present in the header cover before the latter is introduced into the header plate, or indeed regardless of deformations caused by heating the components to the brazing temperature.

However, one of the disadvantages of the above mentioned configuration lies in the difficulty of press-forming a groove which is narrow enough to maintain the edge portion of the header cover correctly in place. Another disadvantage is the resulting size of the header plate, as to both its depth and its height.

Another known solution consists in using a header plate of dished form, in which the edge portion of the header cover is engaged. However, this arrangement does not guarantee that a narrow brazing clearance can be maintained between the edge portion of the header cover and the flange of the header plate.

It is also known, from French patent specification No. FR 2 712 384A, to provide a heat exchanger of a different type, that is to say one that is assembled mechanically, in which projections are provided on a header plate for the purpose of guiding the edge portion of a water box, or header cover, so that the latter then compresses the edge of a sealing body, without the sealing body being damaged.

In that case, the object of the projecting elements is to guide the edge of the header cover in such a way that it will then compress the edge of the sealing body in the region where the edge of the sealing body lies, that is to say within a peripheral groove of the header plate.

DISCUSSION OF THE INVENTION

An object of the present invention is to overcome the above mentioned drawbacks.

According to the invention, a heat exchanger of the type comprising a header plate having a base portion which is adapted to be joined to a bundle of tubes, together with a header cover terminated by a peripheral edge portion or flange which is adapted to be engaged within a peripheral flange of the header plate, with a view to their being subsequently fixed together by a brazing operation, is characterised in that the base portion of the header plate includes a multiplicity of press-formed projecting elements which are spaced apart close to the peripheral flange of the header plate, in such a way as to ensure that the peripheral edge portion of the header cover is maintained in contact against the peripheral flange of the header plate prior to the brazing operation.

Thus, when the peripheral edge portion of the header cover is engaged in the peripheral flange of the header plate by being inserted into the latter, this peripheral edge portion is guided and held in contact against the flange of the header plate. The header plate is thus pre-assembled to the header cover, with tight surface contact between the edge portion of the cover and the flange of the plate over their whole periphery, so that the subsequent brazing operation will produce a reliable sealed joint.

In one embodiment of the invention, each press-formed projecting element defines at least one generatrix which extends in a direction substantially parallel to the peripheral flange of the header plate, and which is situated at a distance from the latter substantially equal to (but not less than) the thickness of the peripheral edge portion of the header cover.

The presence of such generatrices enables the peripheral edge portion of the header cover to be put into close contact with the peripheral flange of the header plate.

In a preferred embodiment of the invention, each press-formed projecting element is made in the form of a peg having a circular generally cylindrical form defining parallel generatrices. However, in another embodiment of the invention, each of these projecting elements is made in the form of a dome.

The invention is applicable in particular to a heat exchanger in which the base portion of the header plate has a multiplicity of holes, each of which is surrounded by an internal bead for receiving an end of a corresponding one of the tubes in the bundle. In that case, according to a preferred feature of the invention, the said projecting elements are disposed between two adjacent internal beads.

The base portion of the header plate, where the latter has internal beads as mentioned above, commonly also has external beads, each of which is disposed between two adjacent internal beads. In such an arrangement, according to another preferred feature of the invention, each of the said projecting elements is situated on the axis of an external bead.

The invention is applicable in particular to a heat exchanger in which the header plate has a substantially rectangular form, and its flange consists of two longitudinal side portions and two transverse side portions. In that case, the said projecting elements are preferably arranged along these longitudinal side portions. It is generally not necessary to provide these projecting elements along the transverse sides.

According to a further preferred feature of the invention, the flange of the header plate has an end portion which is seamed locally against the header cover in order to ensure temporary retention of the latter to the header plate prior to the brazing operation.

The header plate and header cover are preferably both formed of aluminium or aluminium alloy.

Further features and advantages of the invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

Figure 1:
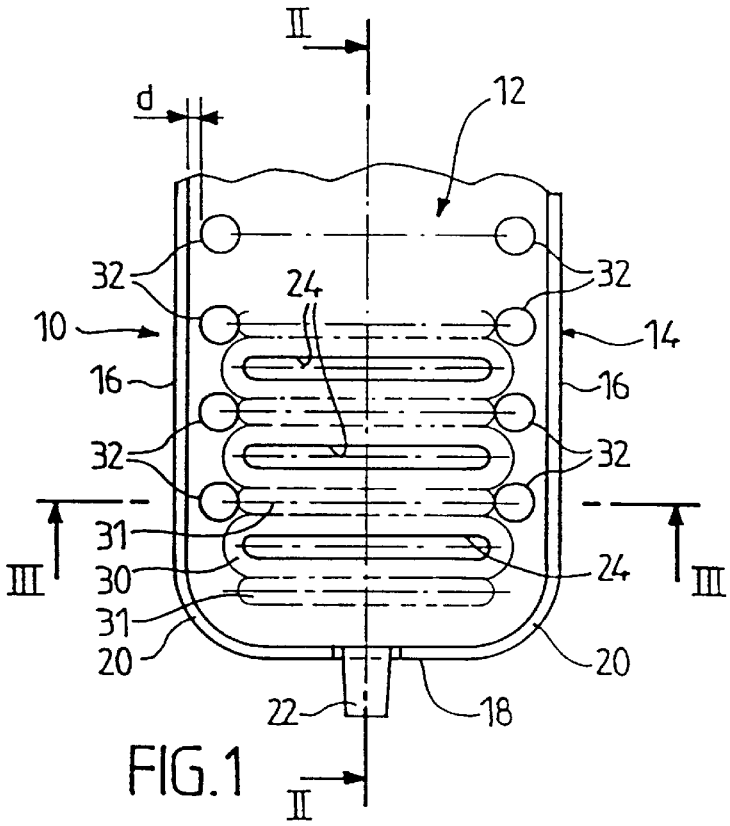
FIG. 1 is a partial top plan view of a header plate for a heat exchanger in accordance with the invention, before the header plate is assembled to a header cover.

Reference is first made to FIG. 1, which shows, in top plan view, part of a header plate 10 which is a component of a heat exchanger in accordance with the invention. The header plate 10 is made of a suitable metallic material, for example aluminium or an aluminium alloy. The header plate 10 is of dished form, and has a generally flat base portion 12 of generally rectangular form, bounded by a peripheral flange 14 which consists of two longitudinal side portions 16 parallel to each other and two transverse side portions 18 parallel to each other. Only one of these can be seen in FIG. 1. The side portions 16 and 18 are joined together by rounded portions 20 in the form of quarter circles. In addition, the header plate 10 includes a lug 22 which extends beyond one of the transverse side portions 18, so as to serve, for example, as a retaining lug.

Figure 2:
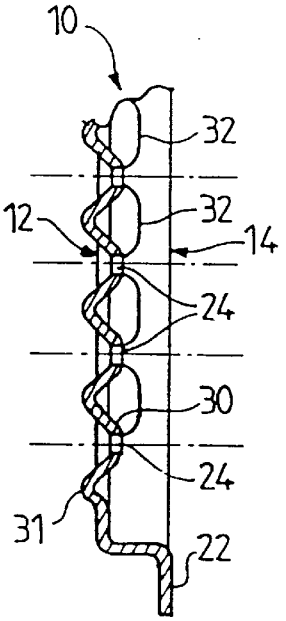
FIG. 2 is a partial view in cross section taken on the line II—II in FIG. 1.
Figure 3:
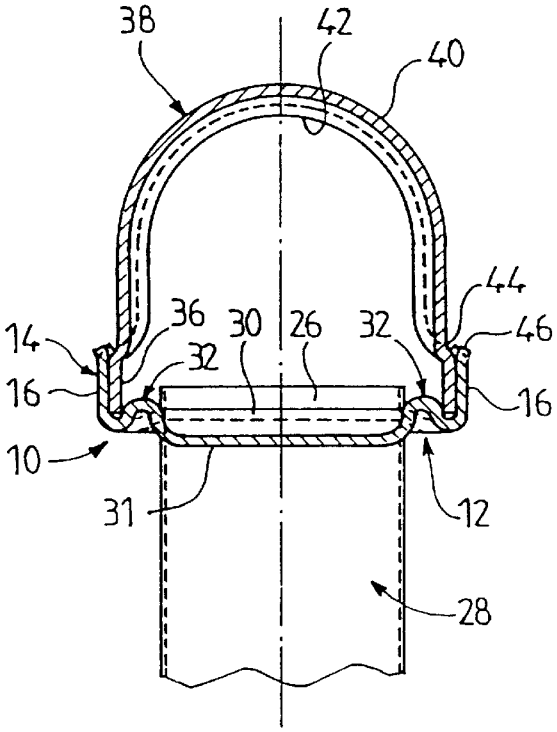
FIG. 3 is a view in cross section taken on the line III—III in FIG. 1, after the header plate has been assembled with a header cover and a bundle of tubes.
Figure 4:
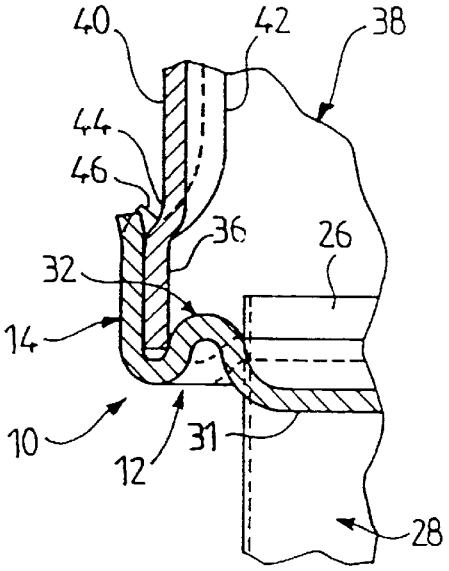
FIG. 4 is a detail of FIG. 3.

A row of oblong holes 24 is formed in the base portion 12 of the header plate, as can be seen in FIGS. 1 and 2. Each of the holes 24 is adapted to receive an end portion 26 of a heat exchanger tube 28, part of which is shown in FIGS. 3 and 4. These tubes constitute a bundle of parallel tubes, and in this example, the tubes 28 are of a flat configuration, with cooling fins in the form of corrugated inserts (not shown) being inserted between the tubes of the bundle. Each of the holes 24 is surrounded by an internal bead 30, the form of which, as shown in FIG. 1, is homologous with that of the hole. The beads 30 project on the same side of the base portion 12 as the peripheral flange 14, as can be seen in FIGS. 2 to 4. In other words, each of the beads 30 is disposed on the same side as the header cover, as will be considered again later herein. The internal beads 30 increase the contact surface area between the header plate 10 and the tubes 28, with a view to the header plate and tubes being fixed together by brazing.

The base portion 12 of the header plate 10 also has external beads 31 (FIGS. 1 to 4), each of which lies between two adjacent internal beads 30. The external beads 31 are of oblong form, and project on the opposite side of the header plate from the flange 14. Their function is essentially to reinforce the base portion 12 of the header plate.

The base portion 12 of the header plate also has a multiplicity of press-formed projecting elements 32, which are arranged in two lines, respectively parallel to the two longitudinal side portions 16 of the peripheral flange 14, as can be seen in FIG. 1. However, as can best be seen in FIGS. 3 and 4, each of the projecting elements 32 constitutes a boss which projects on the same side as the flange 14, that is to say on the same side as the internal beads 30 and therefore on the opposite side from the external beads 31. In the embodiment shown in FIGS. 1 to 4, each of the projecting elements 32 is in the form of a substantially hemispherical dome. Each of these projecting elements 32 is disposed between two adjacent internal beads 30 and in the axis of an external bead 31.

The base of the dome of each projecting element 32 lies at a predetermined distance d (see FIG. 1) from the peripheral flange 14, that is to say with respect to the internal face of a longitudinal side portion 16. This distance d is substantially equal to, but not less than, the thickness of the peripheral edge portion 36 of a header cover 38, which is adapted to be fixed by brazing to the header plate 10. The header cover 38 is made of a metallic material, and is preferably of aluminium or an aluminium alloy. It includes a wall 40 having U-shaped reinforcing ribs 42, as can be seen in FIGS. 2 and 3. The wall 40 is joined to the peripheral edge portion 36 through a shoulder 44, see FIGS. 3 and 4.

The peripheral edge portion 36 has a rectangular contour, with rounded corners. This contour corresponds to that of the peripheral flange 14 of the header plate, so that the header cover and header plate can be assembled together by insertion of the cover in the plate as shown in FIGS. 3 and 4.

The heat exchanger is assembled as follows. The tubes 28 and their cooling fin inserts, mentioned above, are first assembled to the header plate 10. The header cover 38 is then assembled to the header plate 10. To this end, the peripheral edge portion 36 of the header cover is introduced into the peripheral flange 14 of the header plate. Due to the fact that the edge portion 36 and the flange 14 have homologous forms, they fit snugly together. The edge portion 36 of the header cover is guided by the projecting bosses 32, which ensures intimate contact between the edge portion 36 and the flange 14, with a view to their being secured together later by brazing.

In order that the header cover and header plate shall be held together temporarily prior to the brazing operation, the flange 14 is deformed locally at its end, as shown in FIG. 4, so as to form seaming points which are engaged against the shoulder 44. These seaming points are formed from place to place around the perimeter, but preferably only on the two longitudinal side portions 16 of the flange.

The brazing operation is subsequently carried out by passing the heat exchanger through an appropriate oven which causes a layer of braze metal, which has previously been coated on to the various components of the heat exchanger, to melt.

Figure 5:
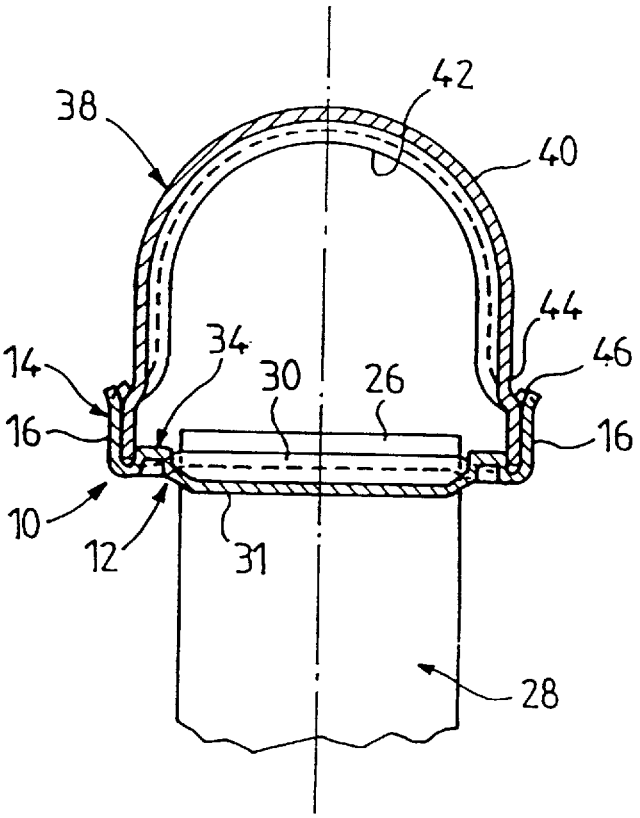
FIG. 5 is a view similar to FIG. 3, but shows a modified embodiment of a header in accordance with the invention.
Figure 6:
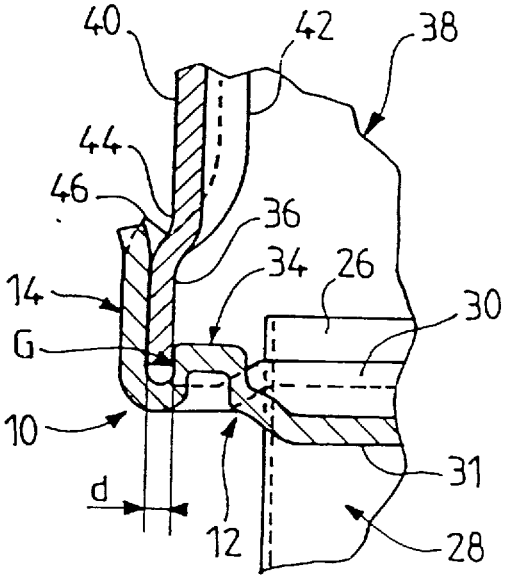
FIG. 6 is a view similar to FIG. 4, but for the same embodiment as is shown in FIG. 5.

Reference is now made to FIGS. 5 and 6 showing a modified embodiment, which is similar to that described above with reference to FIGS. 1 to 4, except as regards the form of the press-formed projecting elements in the base portion of the header plate. In this connection, the base portion 12 in this case includes press-formed projecting elements 34 which are disposed in the same positions as the projecting elements 32 in the preceding embodiment.

However, each of the projecting elements 34 is made in the form of a peg, with a circular, generally cylindrical form having parallel generatrices. In addition, each projecting element 34 defines at least one generatrix G (FIG. 6) which extends in a direction substantially parallel to the peripheral flange 14 of the header plate 10, and which lies at a distance d from the latter which corresponds to the distance d in FIG. 1. In other words, this distance is substantially equal to, but not less than, the thickness of the peripheral edge portion 36 of the header cover 38.

The invention is of course not limited to the embodiments described above by way of example, and does extend to other versions. Thus for example, it is possible to design press-formed projecting elements of different configurations, such as to enable the peripheral edge portion of the header cover to be guided into tight contact with the peripheral flange of the header plate. It is also possible to provide projecting elements along the transverse edges of the header plate, especially if the latter is a header plate of greater width.

The invention is applicable most particularly to the manufacture of heat exchangers which can be used as cooling radiators in motor vehicles.

What is claimed is:

1. A heat exchanger comprising: a bundle of tubes; and a header comprising a header plate and a header cover secured to the header plate, the header plate having a base portion joined to the tubes and a peripheral flange joined to and surrounding the base portion, the header cover having a terminal peripheral edge portion, which joins the wall of the cover through a shoulder, for engagement within the flange of the header plate whereby the peripheral edge portion and peripheral flange can be secured together by brazing, and wherein the header plate base portion further has a multiplicity of press-formed projecting elements positioned at specific distances from the peripheral flange, for maintaining the peripheral edge portion of the header cover in contact against the peripheral flange of the header plate before said brazing takes place, said base portion and said peripheral flange forming, except where said press-formed projecting elements are present, an essentially L-shaped profile in cross-section, such that said peripheral edge portion is prevented from inward deflection away from said flange solely by the presence of said press-formed projecting elements.

2. A heat exchanger according to claim 1, wherein each said press-formed projecting element defines at least one generatrix extending in a direction substantially parallel to the peripheral flange of the header plate, at a distance between the said peripheral flange and the said generatrix which is substantially equal (being at least equal) to the thickness of the said peripheral edge portion of the header cover.

3. A heat exchanger according to claim 2, wherein each press-formed projecting element is a peg-like element of generally circular cylindrical form having parallel generatrices.

4. A heat exchanger according to claim 1, wherein each said press-formed projecting element is in the form of a dome.

5. A heat exchanger according to claim 1, wherein the base portion of the header plate further has a multiplicity of holes and an internal bead surrounding each said hole, with an end portion of a corresponding said tube being received in each said hole, wherein each said projecting element is disposed between two adjacent said internal beads.

6. A heat exchanger according to claim 5, wherein the base portion of the header plate further has external beads, each of which is disposed between two adjacent ones of the said internal beads, each said external bead defining an axis and each said projecting element being centred on the axis of a corresponding external bead.

7. A heat exchanger according to claim 1, in which the peripheral flange of the header plate has a generally rectangular form comprising two longitudinal side portions and two transverse side portions joining is the longitudinal side portions together, the said projecting elements being arranged close to the said longitudinal side portions.

8. A heat exchanger according to claim 1, wherein the peripheral flange of the header plate has an end portion which is seamed locally against the header cover, so as to provide temporary retention of the header plate and header cover together prior to their being secured together by brazing.

9. A heat exchanger according to claim 1, wherein the header plate and header cover are formed of a material selected from aluminium and aluminium alloy.

* * * * *